US005397070A

United States Patent [19]

Yano

[11] Patent Number: 5,397,070

[45] Date of Patent: Mar. 14, 1995

[54] AUTOMATIC COIL WINDER

[75] Inventor: Fumiharu Yano, Toda, Japan

[73] Assignee: Nittoku Engineering Kabushiki Kaisha, Saitama, Japan

[21] Appl. No.: 55,446

[22] Filed: Apr. 29, 1993

[30] Foreign Application Priority Data

May 15, 1992 [JP] Japan ..... 4-123662

[51] Int. Cl.[6] ..... H01B 11/04

[52] U.S. Cl. ..... 242/7.09; 242/7.08

[58] Field of Search ..... 242/7.08, 7.09, 7.14, 242/7.15; 29/605

[56] References Cited

U.S. PATENT DOCUMENTS

| | | | |
|---|---|---|---|
| 3,259,336 | 7/1966 | Hibbard | 242/7.09 X |
| 3,306,554 | 2/1967 | Henderson . | |
| 3,865,152 | 2/1975 | Camardella . | |
| 4,076,055 | 2/1978 | Zolman et al. | 242/7.15 X |
| 4,635,865 | 1/1987 | Arnold | 242/7.09 X |
| 4,722,486 | 2/1988 | Camardella | 242/7.09 X |
| 4,809,917 | 3/1989 | Tsuchiya . | |
| 4,951,889 | 8/1990 | Camardella et al. | 242/7.14 X |
| 5,092,530 | 3/1992 | Noirot et al. | 242/7.09 |

FOREIGN PATENT DOCUMENTS

| | | | |
|---|---|---|---|
| 55-98815 | 7/1980 | Japan | 242/7.09 |
| 218915 | 1/1990 | Japan . | |

OTHER PUBLICATIONS

Patent Abstracts of Japan, vol. 14, No. 161 (E-909) 28 Mar. 1990 & JP-A-02 018 915 (Matsushita Electric) 23 Jan. 1990.

Patent Abstracts of Japan, vol 14, No. 187 (E-917) (4130) 16 Apr. 1990 & JP-A-02 036 507 (Matsushita Electric).

*Primary Examiner*—Daniel P. Stodala
*Assistant Examiner*—Michael R. Mansen
*Attorney, Agent, or Firm*—Jordan and Hamburg

[57] ABSTRACT

An automatic coil winder provided with a turret having a rotation axle for carrying a bobbin and a motor for rotating this rotation axle, and provided with a nozzle for supplying wire to the bobbin, further comprises a mechanism for rotating the turret and a mechanism for fixing the turret in a predetermined rotation position. The rotation axis of the bobbin can therefore be inclined depending on the projection direction of a terminal pin on the bobbin, and the tying of the wire around the pin can be easily accomplished. By providing a displacement mechanism which can displace the turret in three dimensions, it is easy to adapt to operations other than winding such as soldering wire to the terminal pin or taping it to the bobbin, and the entire series of coil manufacturing processes can be automated. Further by linking a tiepin, to which the wire is temporarily attached, to the turret via a link mechanism which can be freely engaged and disengaged, the tying of the wire to the bobbin terminal pin can be performed efficiently.

17 Claims, 11 Drawing Sheets

AUTOMATIC COIL WINDER

FIELD OF THE INVENTION

This invention relates to an automatic coil winder which automatically winds a coil.

BACKGROUND OF THE INVENTION

When a wire coil is wound onto a bobbin, the wire has to be tied to terminal pins provided on the bobbin at the start and end of the winding operation. In conventional winding machines which performed this winding operation automatically, a nozzle for supplying wire was for example moved around a terminal pin on a bobbin supported in a fixed position so as to secure the wire to the pin.

As the nozzle is generally lighter than the bobbin, considering the winding operation alone, it is more logical to have the nozzle move around the bobbin supported in a fixed position than have the bobbin move around a fixed nozzle.

However, considering operations after winding such as soldering, taping, pin cutting, testing, and loading and unloading of the bobbin to a spindle, it is more advantageous from the viewpoint of automation of coil manufacture to fix each operating unit and have the bobbin move between them.

In Tokkai Hei 2-18915 published by the Japanese Patent Office, for example, a coil winder is proposed wherein the nozzle supplying the wire is fixed, and the bobbin is moved around it in three dimensions so as to perform the wire tying operation. In this winder, after the winding operation is completed, the bobbin is progressively moved onto other operating units so that each process in the coil manufacturing operation is performed smoothly.

However, the direction in which the bobbin is supported is fixed, and the bobbin could not be inclined. In general, this type of machine is capable of handling a plurality of bobbin types, but in different types of bobbin, the terminal pins of the bobbin do not necessarily project in the same direction. If therefore the bobbin was supported in a fixed direction, there was a risk that this difference in the projection direction of the pins would interfere with operations after winding such as tying the wire to the pin or soldering on the wire-tied pin.

Moreover, in this winder, the wire was tied to the terminal pins by moving the bobbin with respect to the fixed nozzle, the wire being gripped by chucks installed on both the bobbin and the nozzle. These chucks were provided with independent drive mechanisms.

However, provision of chucks on both the bobbin and the nozzle made the structure of the device unavoidably complex.

In particular, as the chuck on the bobbin always moves together with the bobbin, the chuck has to be withdrawn frown the operating area during operations other than wire tying such as coil winding or winding a tape on the coil. This required a complex drive mechanism so that the chuck on the bobbin could be moved into the correct position for wire tying, or withdrawn.

SUMMARY OF THE INVENTION

It is therefore an object of this invention to provide an automatic coil winder which can easily adapt to the difference in the projection direction of a bobbin terminal pin.

It is a further object of this invention to tie a wire to a coil terminal pin and cut the wire after tying by means of a simple construction.

It is yet a further object of this invention to automate a coil manufacturing process including coil winding and other operations.

In order to achieve the above object, this invention provides an automatic coil winder with a turret having a rotating axle for carrying a bobbin and a device for rotating this axle, and with a nozzle for supplying wire to the bobbin. The winder comprises a device for rotating the turret, and a device for fixing the turret in a predetermined rotation position.

It is preferable that the rotation device comprises a motor and the position fixing device comprises an intermittent indexing mechanism.

It is also preferable that the rotation device and position fixing device comprise a servomotor provided with gears.

It is also preferable that the rotation device and position fixing device comprise a direct drive motor.

This invention also provides an automatic coil winder comprising a device for rotating the turret, a device for fixing the turret in a predetermined rotation position, and a device for displacing the turret in three dimensions.

This invention also provides an automatic coil winder comprising a device for rotating the turret, a device for fixing the turret in a predetermined rotation position, a device for displacing the turret in three dimensions, a tiepin to which the wire is temporarily attached, this tiepin being supported such that it can be freely displaced in three dimensions, and a link mechanism for connecting the turret to the tiepin, this mechanism being freely engaged and disengaged.

The details as well as other features and advantages of this invention are set forth in the remainder of the specification and are shown in the accompanying drawings.

DESCRIPTION OF THE PREFERRED EMBODIMENTS

Figure 1:
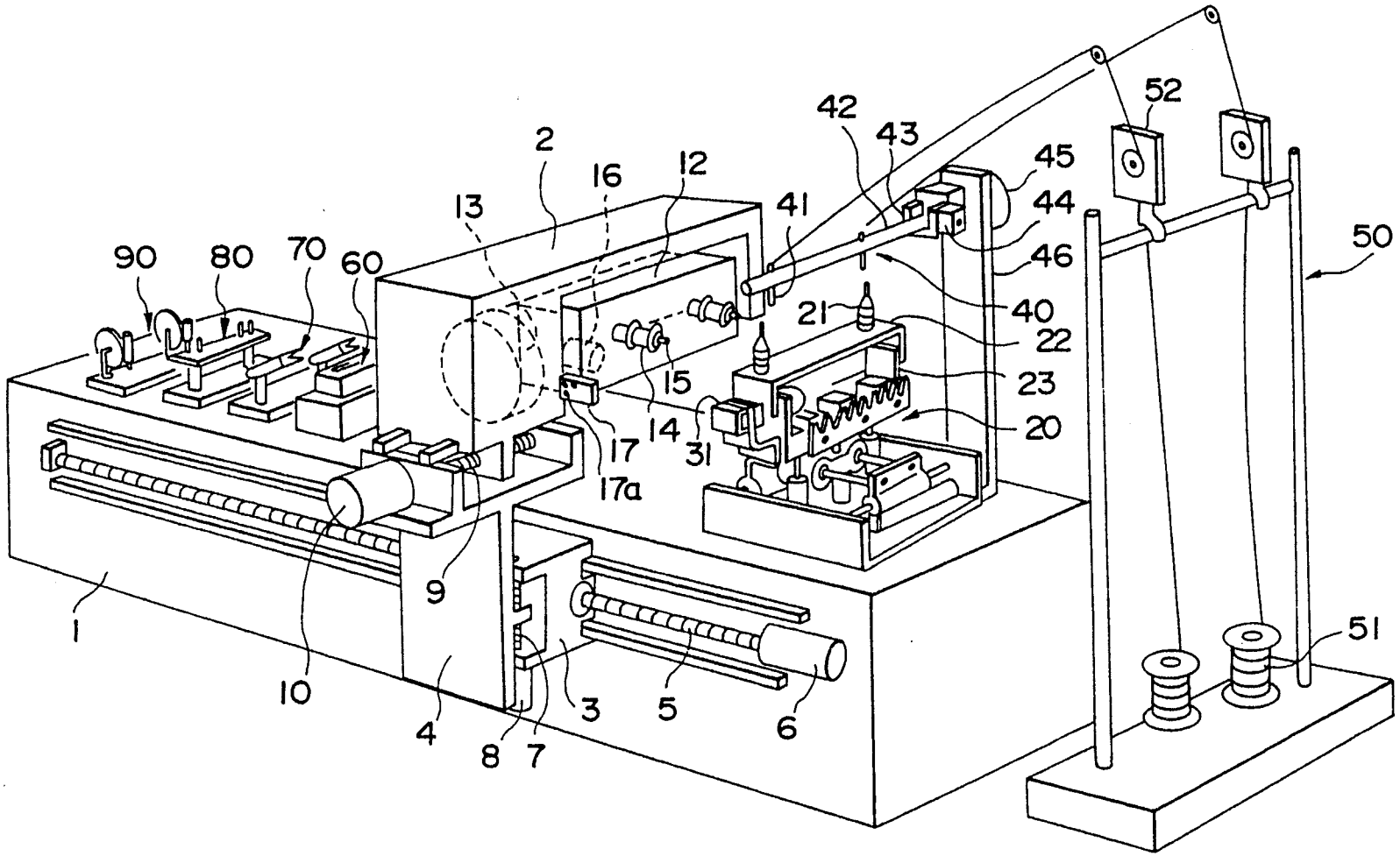
FIG. 1 is a perspective view of an automatic coil winder according to this invention.

Referring to FIG. 1 of the drawings, an automatic coil winder is provided with a turret platform 2 supported on a base 1.

The turret platform 2 is supported on the base 1 via blocks 3 and 4. A ball race 5 is disposed horizontally in a forward-backward direction on the base 1, this ball race 5 being rotated by a forward/backward servomotor 6. The block 3 engages with this ball race 5, and moves forwards and backwards when the servomotor 6 is operated.

A ball race 7 is disposed vertically in the block 3, this ball race 7 being rotated by an up/down servomotor 8. The block 4 engages with this ball race 7, and moves up and down when the servomotor 8 is operated.

A ball race 9 is disposed horizontally and transverse to the base 1 in the block 4, this ball race 9 being rotated by a left/right servomotor 10. The turret platform 2 engages with the ball race 9, and moves transverse to the base 1 when the servomotor 10 is operated.

The turret platform 2 can therefore be moved in any direction in three dimensions on the base 1 by a displacement mechanism comprising the servomotors 6, 8 and 10.

A turret 12 is supported such that it is free to pivot about a horizontal axis in the turret platform 2 parallel to the ball race 9. A direct drive servomotor 13 is also provided in the turret platform 2 as a means to rotate and position the turret 12.

The turret 12 is provided with a plurality of parallel spindles 15 which serve as rotation axes for bobbins 14. Only two spindles 15 are drawn in the figure, but the number of spindles may be increased as desired depending on the dimensional specifications of the turret 12. These spindles 15 rotate the bobbins 14 when a spindle rotation motor 16 housed in the turret 12 is operated.

A band-shaped connecting plate 17 having throughholes 17*a* projects horizontally from the turret platform 2.

Figure 2:
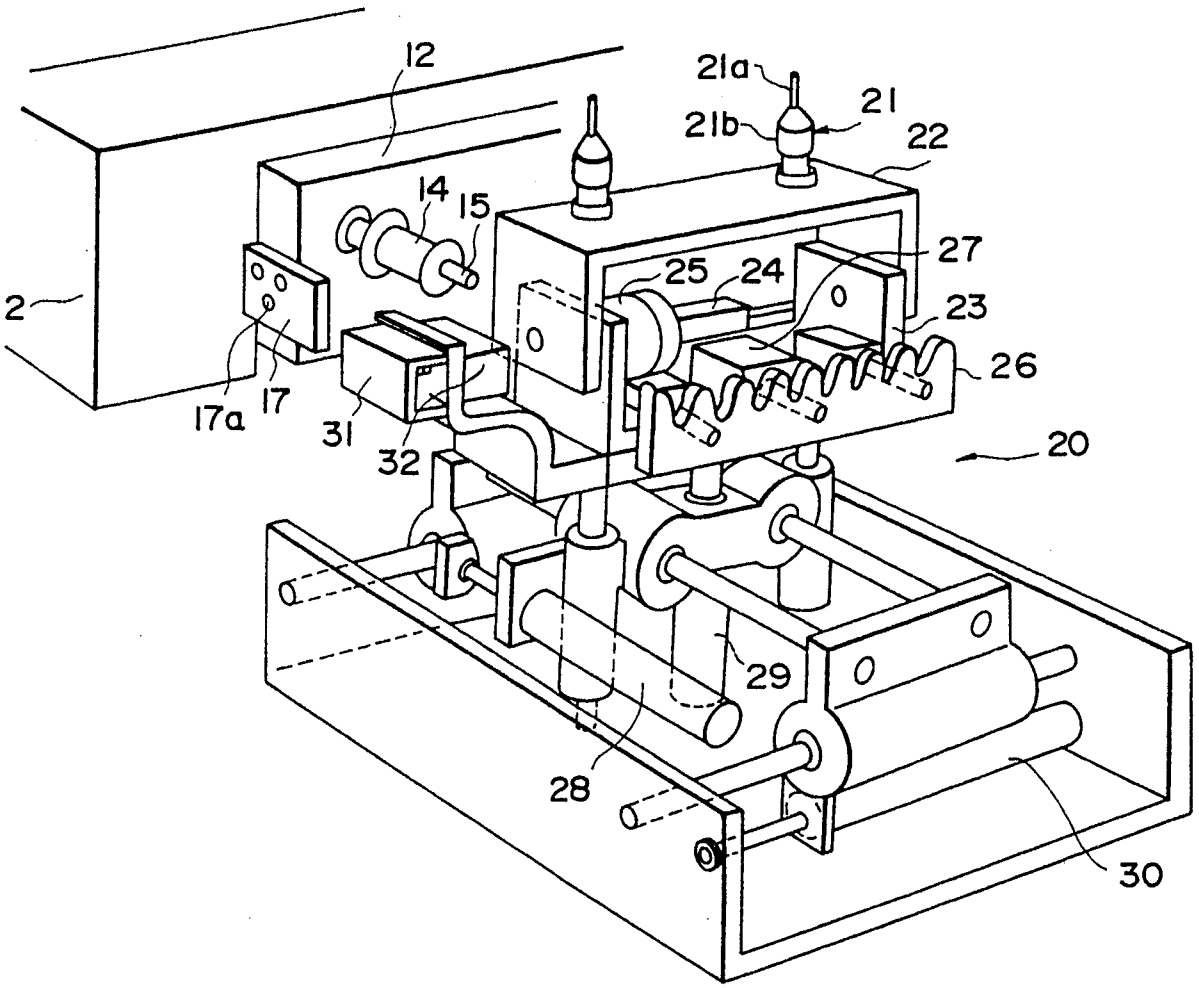
FIG. 2 is an enlarged perspective view of a wire holder of the automatic coil winder.

A wire holder 20 shown in FIG. 2 is also provided close to an edge of the base 1.

The wire holder 20 comprises a tiepin platform 22 which supports a plurality of parallel tiepins 21 equivalent in number to the number of spindles 15, and a holder 23 which supports the platform 22 such that the latter is free to rotate forwards or backwards about a horizontal rotation axis.

The tiepins 21 each comprise a rod-shaped main part 21*a*, and a tapered sleeve 21*b* of greater diameter which fits over the outer circumference of the main part 21*a*. This sleeve 21*b* is supported elastically in the middle of the main part 21*a* by a spring, not shown, and slides along the main part 21*a* depending on the load exerted by an external force.

The tiepins 21 are supported by the tiepin platform 22 and a holder 23 which can be displaced transverse to the base 1 by means of a cylinder 24. Due to this displacement, wire stretched between a terminal pin 14*a* of the bobbin 14 and a tiepin 21 is cut.

A rotary actuator 25 which swivels the tiepin platform 22 in a forwards/backwards direction is housed in the holder 23. A wire discharge plate 26 having a plurality of wave-shaped grooves is supported by the holder 23 via a wire discharge cylinder 27 as a means of eliminating wire tied to the tiepins 21.

Figure 3:
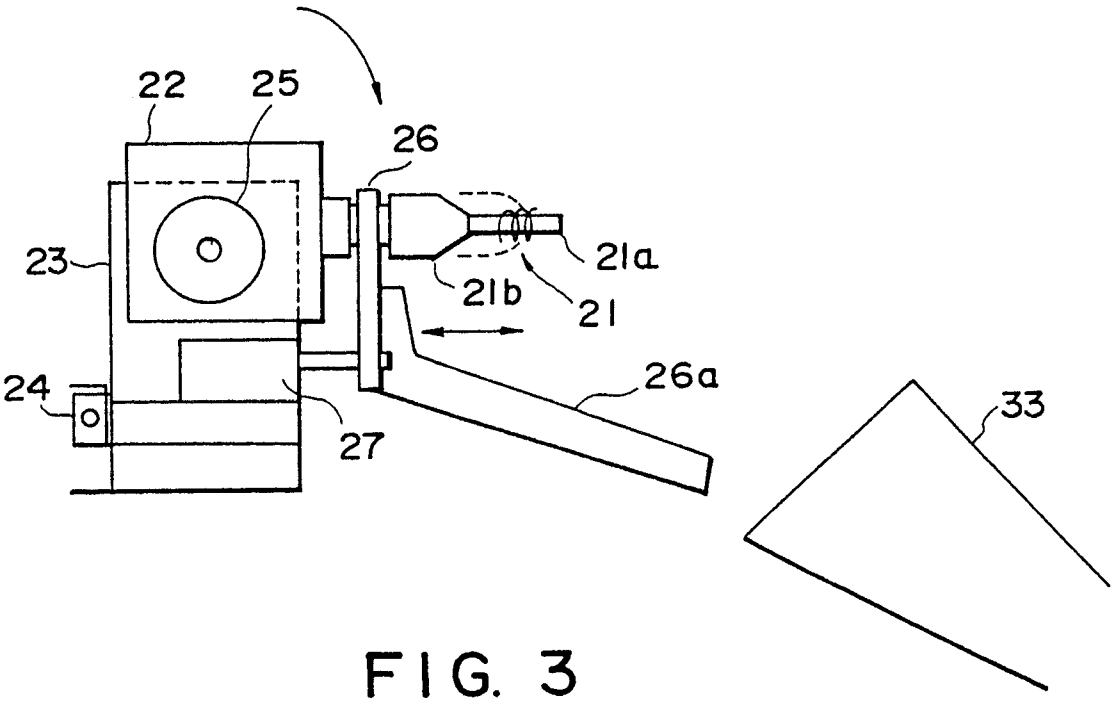
FIG. 3 is an enlarged side view of a tiepin of the automatic coil winder.

When the tiepin platform 22 is swivelled forwards and the wire discharge cylinder 27 is elongated with a tiepin 21 supported on the inside of a groove of the wire discharge plate 26, as shown in FIG. 3, the plate 26 moves the sleeve 21*b* of the tiepin 21 towards the tip of the tiepin so that wire tied around the main part 21*a* of the tiepin is pushed off.

The holder 23 is supported such that it can slide freely within a predetermined range in a forward/backward, up/down or left/fight direction with respect to the base 1 via a cylinder 28 which moves forwards and backwards, a cylinder 29 which moves up and down, and a cylinder 30 which moves left and right.

A connecting plate guide 31 is also fixed on the holder 23. When the turret platform 2 is moved forwards, the connecting plate 17 projecting from the turret platform 2 slides freely into the connecting plate guide 31. The connecting late guide 31 is equipped with a cylinder 32. This cylinder 32 and the connecting plate 17 compose a link mechanism which connects the turret 12 and holder 23. The cylinder 32 has a piston rod not shown which projects into the connecting plate guide 31 and the connecting plate 17 has throughholes 17*a* which accommodate this piston rod. When the connecting plate 17 slides into the guide 31 and the piston rod projects from the cylinder 32 into any of the throughholes 17*a*, the guide 31 and the connecting plate 17 are held rigidly together, and when the piston rod is withdrawn frown the throughhole 17*a*, the mechanism is released.

A nozzle unit 40 is provided above the wire holder 20. The nozzle unit 40 comprises a nozzle bar 42 carrying a plurality of nozzles 41 equivalent in number to the number of spindles 15, this bar 42 being supported on a stand 46 fixed to the base 1 via a holder 43, fixing cylinder 44 and rotary actuator 45.

Figure 12:
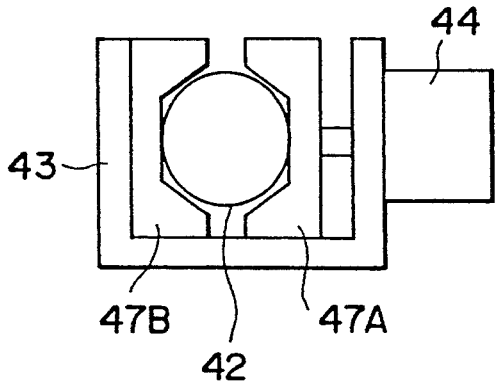
FIG. 12 is a horizontal sectional view through a holder for supporting a nozzle bar of the automatic coil winder.

The holder 43 is supported in the stand 46 such that it can be pivoted freely about a horizontal axis by the rotary actuator 45. The fixing cylinder 44 is connected to a tightening member 47A housed in the holder 43 as shown in FIG. 12, and the end of the nozzle bar 42 is gripped between this tightening member 47A and an opposite tightening member 47B housed in the holder 43 such that the end of the bar 42 is engaged with the holder 43.

Wire is supplied to a nozzle 41 from a wire supply unit 50 fixed to the floor surface independently of the base 1. The wire supply unit 50 comprises a bobbin 51 of wire and a tensioner 52 which maintains the tension of the wire supplied to the nozzle 41 from the bobbin 51 at a predetermined level.

A soldering unit 60 is installed at a position on the base 1 distant from the wire holder 20, and a cutting unit 70, testing unit 80 and taping unit 90 are also installed on the base 1 in sequential order away from the wire holder 20.

Figure 4:
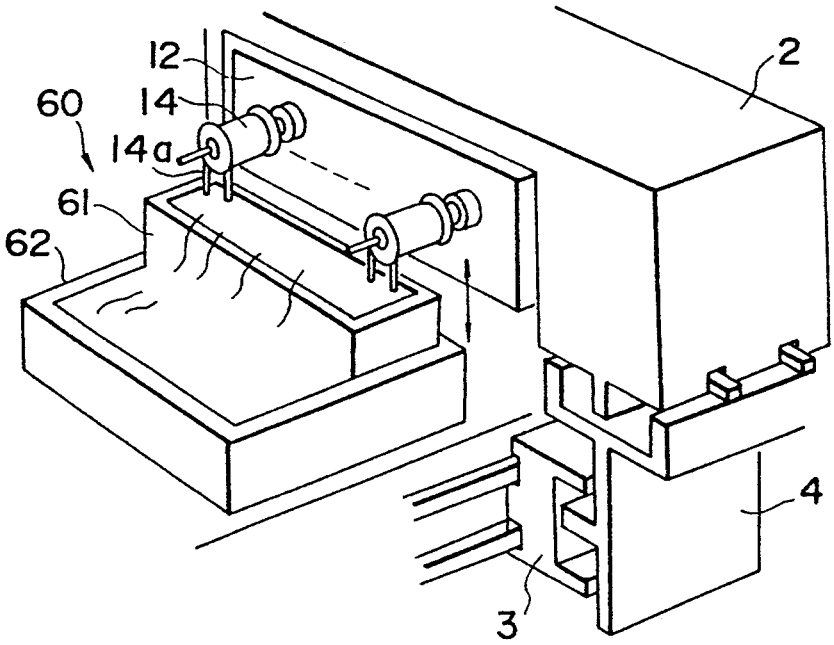
FIG. 4 is an enlarged perspective view of a soldering unit of the automatic coil winder.
Figure 5:
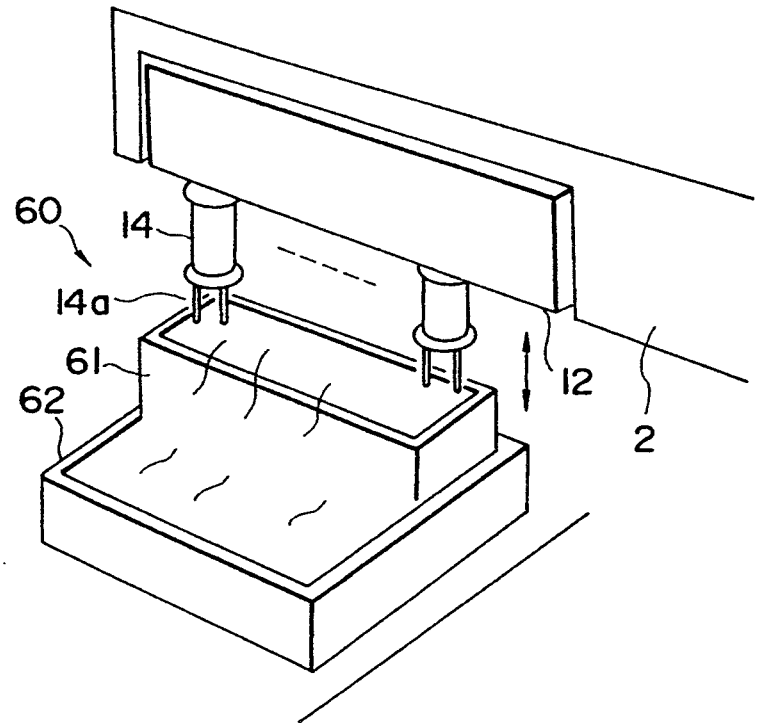
FIG. 5 is similar to FIG. 4, but showing the operation of the soldering unit in a different situation.

The soldering unit 60 comprises a solder basin 61 to wet the terminal pins 14*a* around which the beginning and end of the wire on the bobbin 14 have been tied, and an overflow basin 62 for collecting solder which has overflown frown the solder basin 61, as shown in FIG. 4.

Figure 6:
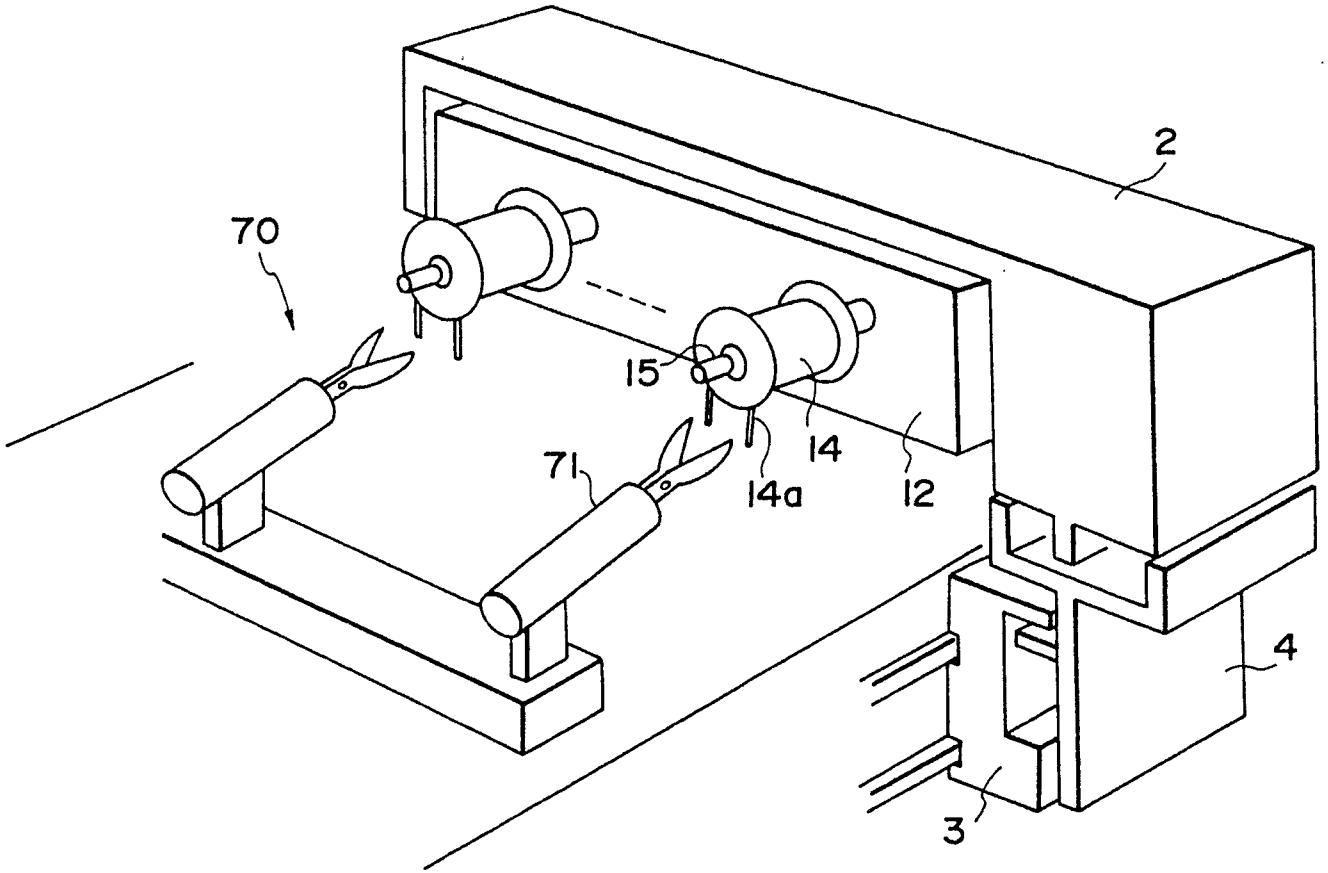
FIG. 6 is an enlarged perspective view of a cutting unit of the automatic coil winder.

The cutting unit 70 is provided with air nippers 71 equivalent in number to the number of spindles 15 which project forwards as shown in FIG. 6 so as to cut solder which has dripped down from the pins 14*a*.

Figure 7:
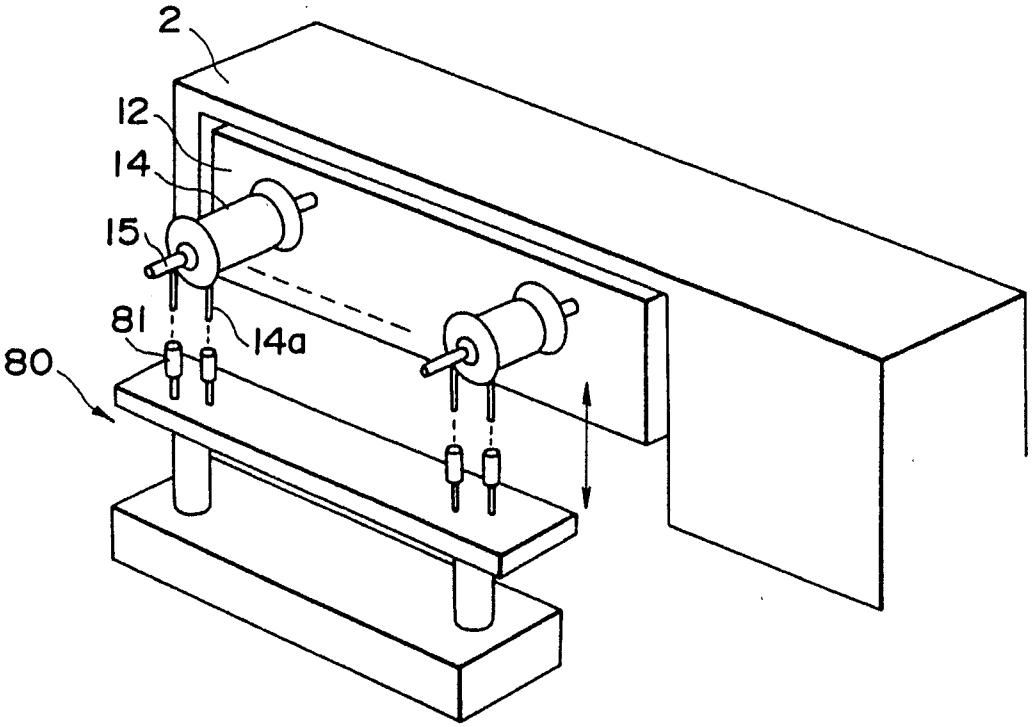
FIG. 7 is an enlarged perspective view of a testing unit of the automatic coil winder.

The testing unit 80 is provided with contact pins 81 equivalent in number to the number of spindles 15, these pins being electrically connected to the terminal pins 14*a* as shown in FIG. 7.

The taping unit 90 comprises a tape reel 91 on which is wound a tape 95, a chuck 92 for gripping the end of the tape 95 paid out from the tape reel 91, and a cutter 93 for cutting the end of the tape wound on the bobbin 14. The chuck 92 is opened and closed by a chuck cylinder 94, and is moved parallel to the turret 12 by a cylinder 96 which moves to the left and right. The cutter 93 is also moved up and down by a cutter cylinder 97. The surface of the tape 95 is coated with an adhesive.

The operation of this winder will now be described.

The winding of wire onto the bobbin 14 is performed according to the process shown in FIG. 10. First, from the state shown in FIG. 1, the forward/backward servomotor 6 is operated so that the turret plafform 2 approaches the wire holder 20, and the connecting plate 17 is inserted in the guide 31 so that it is held by the connecting cylinder 32 (FIG. 10A). Wire supplied from the nozzle 41 is then tied to the tiepin 21. As the connecting plate 17 has a plurality of throughholes 17*a*, the distance between the turret platform 2 and the wire holder 20 and their relative height when they are connected together can be freely selected. Easy adaptation can therefore be made if the size of the bobbin 14 is changed.

Figure 10A:
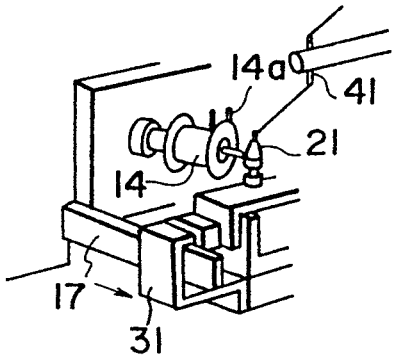
FIGS. 10A–10H are a perspective view of the main part of the automatic coil winder showing the processes involved in coil winding in order according to this invention.
Figure 10B:
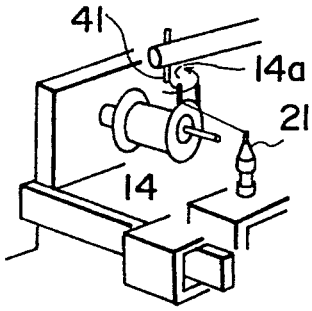
Figure 10C:
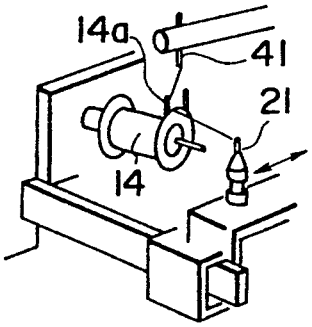

Next, the forward/backward servomotor 6, up/down servomotor 8 and left/right servomotor 10 are operated so that the bobbin 14 and tiepin 21 move together along a circular path at a suitable height. The middle part of the wire extending from the fixed nozzle 41 to the tiepin 21 is thereby tied around the terminal pin 14*a* on the bobbin 14 (FIG. 10B). The tiepin 21 is then moved by the pin displacement cylinder 24 in the direction shown in FIG. 10C so as to cut the wire.

Next, the spindle rotation motor 16 is operated so that the bobbin 14 is rotated via the spindle 15 while moving the bobbin back and forth in a horizontal direction. Wire supplied from the nozzle 41 is thereby wound on the bobbin 14.

Figure 10D:
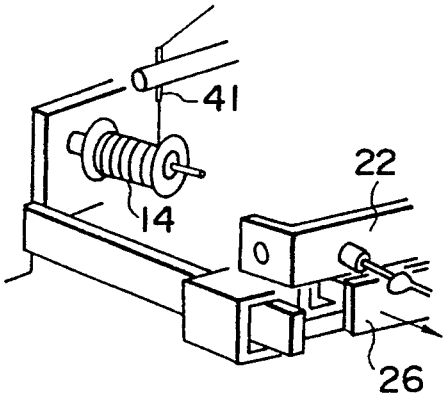

At the same time, the rotary actuator 25 is operated so as to swivel the tiepin platform 22 forwards through 90 degrees, causing the tiepin 21 to fall into a groove of the wire discharge plate 26. Due to the elongation of the wire discharge cylinder 27, the sleeve 21*b* of the tiepin 21 is pushed forward via the wire discharge plate 26 as shown in FIG. 10D, and wire tied to the main part 21*a* of the tiepin 21 is thereby removed. The wire discharge plate 26 is also provided with a guide 26*a* as shown in FIG. 3, and a collecting bin 33 for collecting the removed wire ends opens towards this guide 26*a* in order to prevent scattering of these wire ends. After discharging the wire ends, the rotary actuator 25 is again operated so as to swivel the tiepin support platform 22 back to its original position.

Figure 10E:
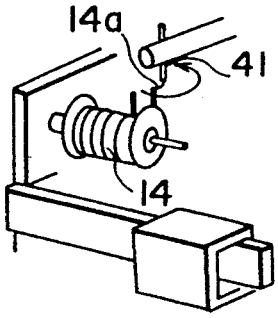

After the wire has been wound onto the bobbin 14, the servomotors 6, 8, 10 are operated so that the bobbin 14 moves along a circular path, and wire supplied from the nozzle 41 is tied around the other terminal pin 14*a* of the bobbin 14 (FIG. 10E).

Figure 10F:
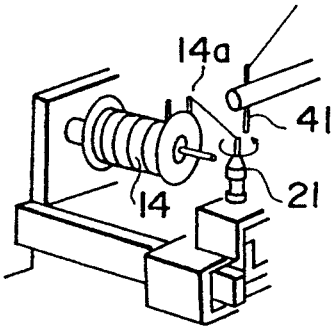

The servomotors 6, 8, 10 are then operated so that the bobbin 14 and tiepin 21 move together along a circular path, and the wire is tied around the tiepin 21 (FIG. 10F).

Figure 10G:
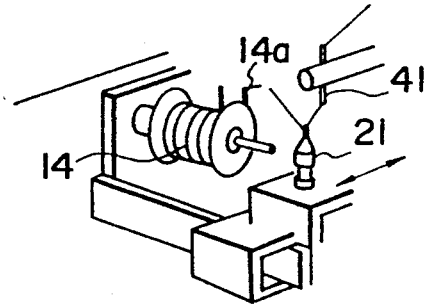

Next, the tiepin displacement cylinder 24 is operated so as to move the tiepin 21 together with the tiepin support platform 22, and the wire between the tiepin 21 and the terminal pin 14*a* on the bobbin 14 is cut (FIG. 10G).

Figure 10H:
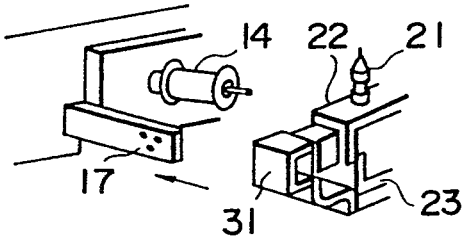

Finally, the turret platform 2 and the holder 23 are separated from one another which completes the winding operation (FIG. 10H). In this state, wire supplied from the nozzle 41 can be tied around a tiepin 21 in the same way as before the operation was started, and the operation of winding wire on the next bobbin 14 can be begun at any time.

If wires of different diameters are to be wound on top of each other, the nozzle bar 42 can be changed over by a change-over device, not shown, while the turret 12 is being moved on to other operating units.

When the operation of winding wire onto the bobbin 14 is completed, the turret platform 2 is moved back to the soldering unit 60, the servomotor 13 is operated so as to rotate the turret platform 2 through 180 degrees, and the up/down servomotor 8 is operated so as to move the bobbin 14 down and immerse the terminal pins 14*a* in the solder basin 61.

If the bobbin 14 is provided with terminal pins 14*a* which project parallel to the spindles 15, the turret 12 may also be rotated through 90 degrees so that the terminal pins 14*a* are oriented downwards. The turret 12 can be rotated into any desired position by the servomotor 13, and so the bobbin 14 can be held in the optimum rotation position for performing operations regardless of the projection direction of the terminal pins 14*a*.

The turret platform 2 is moved back to the cutting unit 70, and dripping solder adhering to the terminal pins 14*a* is cut by the air nippers 71 as shown in FIG. 6.

Figure 8:
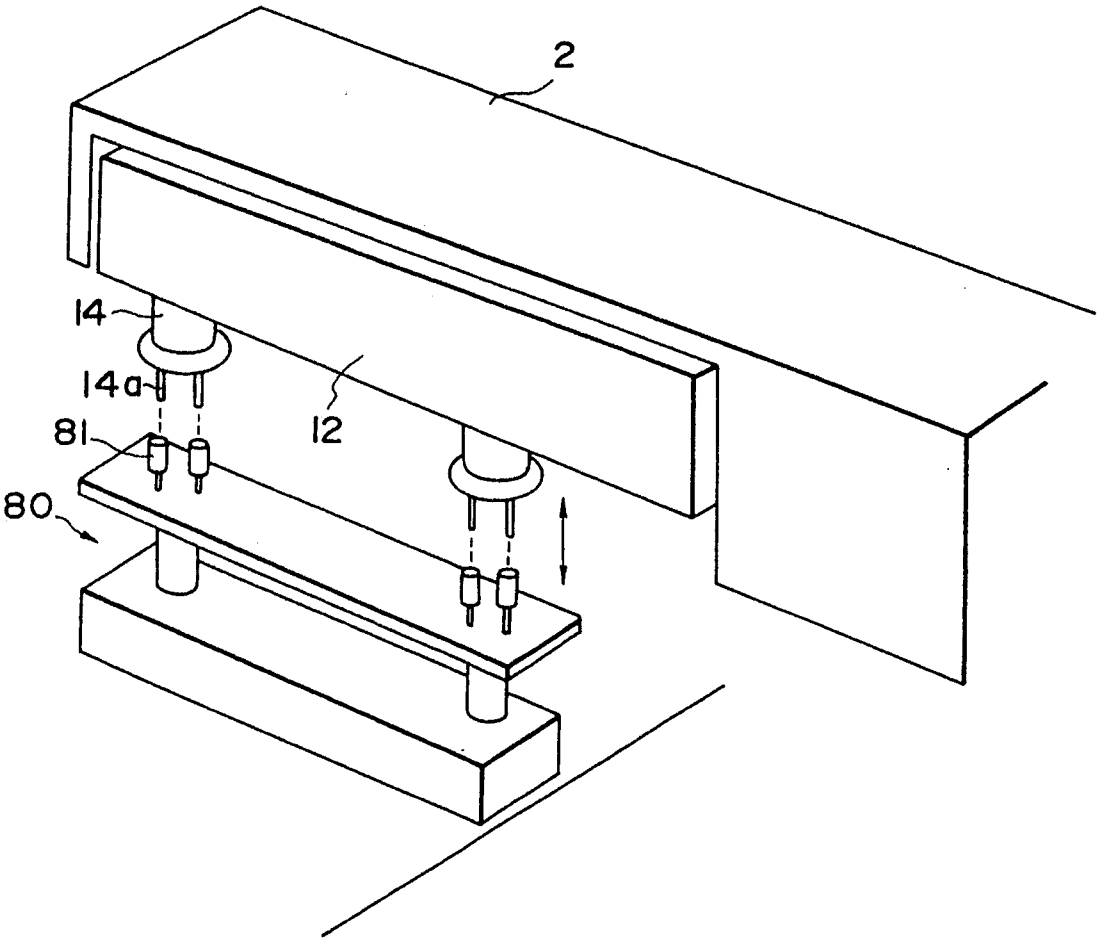
FIG. 8 is similar to FIG. 7, but showing the operation of the testing unit in a different situation.

The turret platform 2 is then moved further back to the testing unit 80, where the terminal pins 14*a* are brought into contact with the contact pins 81 as shown in FIG. 7 in order to pass a current and test the coil. If the terminal pins 14*a* project parallel to the spindles 15, the terminal pins 14*a* can be brought into contact with the contact pins 81 by supporting the turret platform 2 in the rotation position shown in FIG. 8.

Finally, the turret platform 2 is moved back to the taping unit 90. The turret platform 2 is first moved down from the position shown in FIG. 9, the part of the bobbin 14 wound with wire is pushed against the tape 95, the chuck 92 is released and the spindle rotation motor 16 is operated so as to rotate the bobbin 14. The adhesive tape 95 is thereby wound on the outer circumference of the wire coil on the bobbin 14. The cutter 93 is then moved up by the cutter cylinder 97 so as to cut the end of the tape 95 which has been wound.

Figure 9:
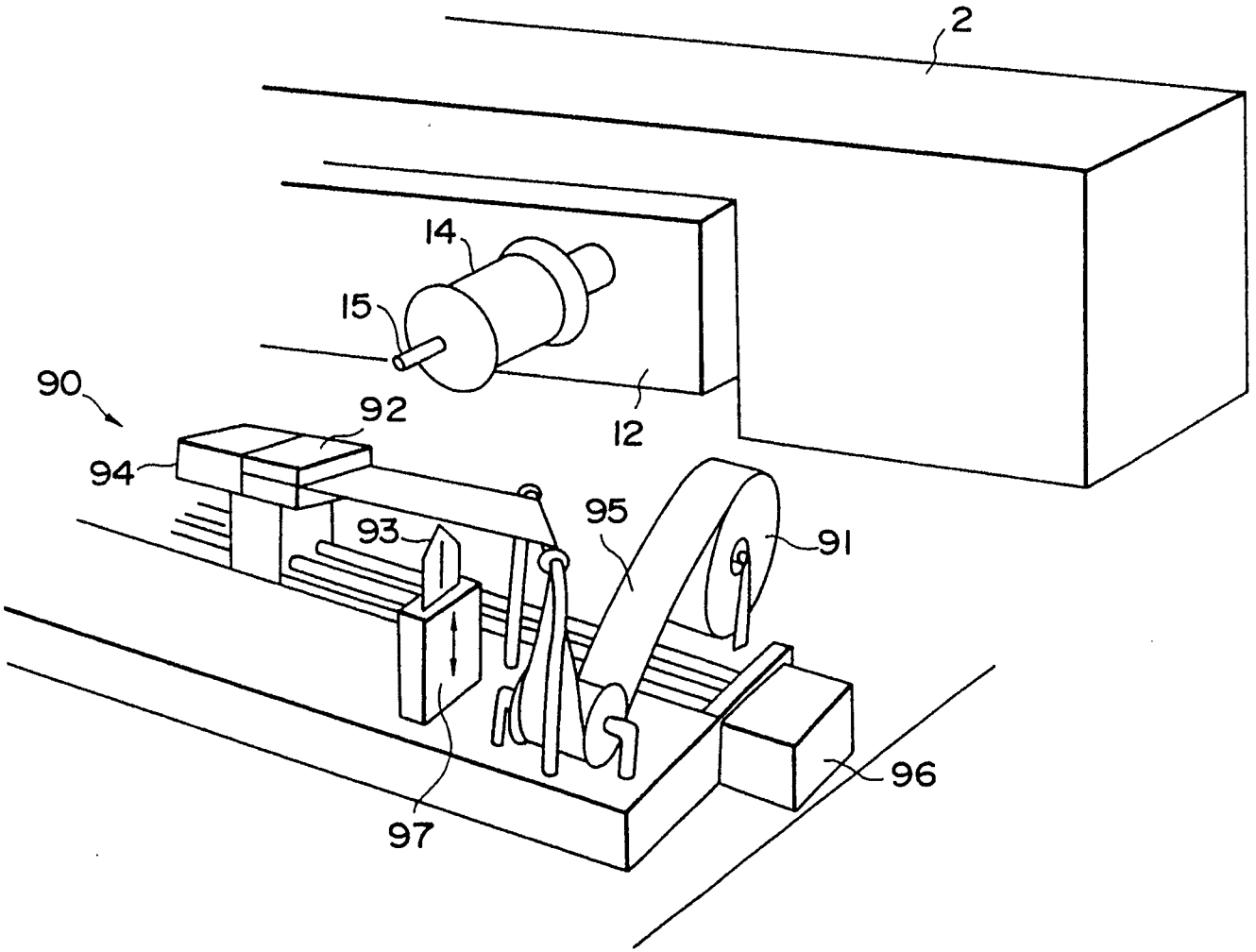
FIG. 9 is an enlarged perspective view of a taping unit of the automatic coil winder.

The end of the cut tape 95 on the side of the taping unit 90 is gripped by driving the left/right displacement cylinder 96 and the chuck cylinder 94 so that it is again held in the position shown in FIG. 9. The entire coil manufacturing operation frown winding to taping is thereby performed automatically while the turret platform 2 moves on the base 1, and coils can therefore be manufactured efficiently.

If it is desired to further increase productivity, the number of spindles 15 and the number of operating mechanisms in each unit may be increased. As these mechanisms are disposed in transverse rows on the base 1, a desired productivity can be achieved without changing the basic construction merely by extending the turret 12 and operating units in a transverse direction to the base 1.

Figure 11:
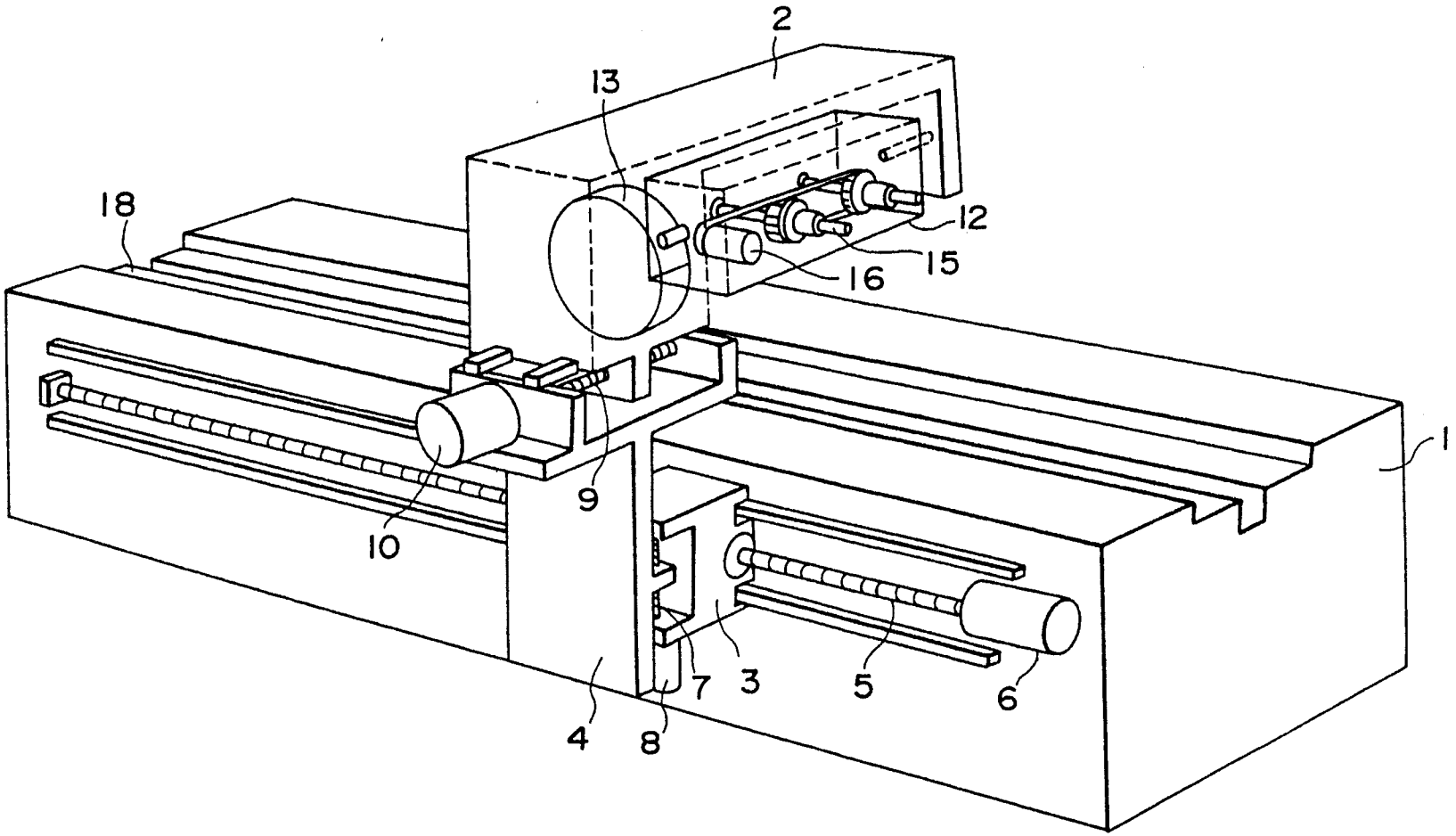
FIG. 11 is a perspective view of a base and a turret platform of the automatic coil winder.

If a T-shaped groove 18 is formed in the base 1 as shown in FIG. 11 in order to fix the operating units, the Operating units may be more easily positioned when they are mounted on the base 1, and the units or their layout may be easily modified.

The means of rotating the turret 12 may consist of an ordinary AC motor, and the means of positioning the turret 12 may consist of an index drive mechanism.

Alternatively, the means of rotating and positioning the turret 12 may consist of servomotors provided with gears.

The foregoing description of the preferred embodiments for the purpose of illustrating this invention is not to be considered as limiting or restricting the invention, since many modifications may be made by those skilled in the art without departing from the scope of the invention.

The embodiments of this invention in which an exclusive property or privilege is claimed are defined as follows:

1. An automatic coil winder comprising:
a turret having a rotating axle for carrying a bobbin,
means for rotating said axle,
a nozzle for supplying wire to said bobbin,
means for rotating said turret about an axis orthogonal to an axis defined by said axle,
means for fixing said turret in a predetermined rotation position, and
means for displacing said turret in three dimensions.

2. An automatic coil winder as defined in claim 1, wherein said means for rotating includes a servomotor provided with gears for rotating the turret and said position fixing means includes a servomotor provided with gears for fixing said turret in said predetermined rotation position.

3. An automatic coil winder as defined in claim 1, wherein said means for rotating said turret includes a direct drive motor for rotating the turret and said position fixing means includes a direct drive motor for fixing said turret in said predetermined rotation position.

4. An automatic coil winder as defined in claim 1, wherein there are a plurality of said rotating axles on said turret.

5. An automatic coil winder as defined in claim 1, wherein said means for displacing includes first motor means for causing displacement of said turret in a first direction, second motor means for causing displacement of said turret in a second direction different from said first direction, and third motor means for causing displacement of said turret in a third direction different from said first and second directions.

6. An automatic coil winder according to claim 5, wherein said first, second and third directions are orthogonal to each other.

7. An automatic coil winder according to claim 1, further including a turret platform for rotatably supporting said turret, and said means for displacing is connected with said turret platform for displacing said turret platform, and thereby said turret, in said three dimensions.

8. An automatic coil winder comprising:
a turret having a rotating axle for carrying a bobbin,
means for rotating said axle,
a nozzle for supplying wire to said bobbin,
means for rotating said turret about an axis orthogonal to an axis defined by said axle,
means for fixing said turret in a predetermined rotation position,
means for displacing said turret in three dimensions,
tiepin for temporarily attaching said wire supplied to the bobbin, said tiepin being supported such that it can be freely displaced in three dimensions, and
a link mechanism for releasably connecting said turret to said tiepin.

9. An automatic coil winder as defined in claim 8, wherein said means for rotating includes a servomotor provided with gears for rotating the turret and said position fixing means includes a servomotor provided with gears for fixing said turret in said predetermined rotation position.

10. An automatic coil winder as defined in claim 8, wherein said means for rotating said turret includes a direct drive motor and said position fixing means includes a direct drive motor.

11. An automatic coil winder as defined in claim 8, wherein there are a plurality of said rotating axles on said turret.

12. An automatic coil winder as defined in claim 8, wherein said means for displacing includes first motor means for causing displacement of said turret in a first direction, second motor means for causing displacement of said turret in a second direction different from said first direction, and third motor means for causing displacement of said turret in a third direction different from said first and second directions.

13. An automatic coil winder according to claim 12, wherein said first, second and third directions are orthogonal to each other.

14. An automatic coil winder according to claim 8, further including a turret platform for rotatably supporting said turret, and said means for displacing is connected with said turret platform for displacing said turret platform, and thereby said turret, in said three dimensions.

15. An automatic coil winder according to claim 14, further including a tiepin platform for supporting said tiepin, and
wherein said link mechanism includes:
a connecting plate secured to said turret platform, and
engaging means on said tiepin platform for engaging said connecting plate to releasably connect said tiepin platform to said turret platform.

16. A automatic coil winder according to claim 15, wherein said link mechanism further includes a plate guide secured to said tiepin platform for receiving said connecting plate.

17. An automatic coil winder according to claim 8, further including a platform for supporting said tiepin, and means for displacing said platform turret in three dimensions.

* * * * *